United States Patent [19]

Yamashita et al.

[11] 4,245,024

[45] Jan. 13, 1981

[54] DEVELOPMENT PROCESS FOR AN ELECTROPHOTOGRAPHIC DUPLICATOR EMPLOYING MAGNETIC TONER

[75] Inventors: Keitaro Yamashita, Kamisato; Toshio Numata, Kumagaya, both of Japan

[73] Assignee: Hitachi Metals, Ltd., Tokyo, Japan

[21] Appl. No.: 960,012

[22] Filed: Nov. 13, 1978

[30] Foreign Application Priority Data

Nov. 10, 1977 [JP] Japan ..... 52-135083

[51] Int. Cl.[3] ..... B05D 1/06

[52] U.S. Cl. ..... 430/122; 430/126

[58] Field of Search ..... 427/18; 430/30, 120, 430/122, 126; 118/657-658

[56] References Cited

U.S. PATENT DOCUMENTS

| | | | |
|---|---|---|---|
| 3,909,258 | 9/1975 | Kotz | 427/18 |
| 4,081,571 | 5/1978 | Nishihama et al. | 427/18 |

*Primary Examiner*—Morris Kaplan

*Attorney, Agent, or Firm*—Finnegan, Henderson, Farabow, Garrett & Dunner

[57] ABSTRACT

A development process for an electrophotographic duplicator using magnetic toner and a photosensitive material selected from the group consisting of selenium, organic semiconductor, and cadmium sulfide. The magnetic toner is transferred in a maximum thickness of 1.5 mm onto a cylindrical non-magnetic sleeve enclosing a magnetic roll. The magnetic force of the roll on the sleeve is in the range of from 300 to 1000 gauss and the toner comprises magnetite in the range of 40 to 70 percent by volume and has a volume specific resistivity higher than $10^7$ ohm-cm and a granulometric measure of less than 30 $\mu$m. A surface potential is applied in the range of from 300 to 1200 volts on the photosensitive material formed on the surface of a rotatable drum-shaped member. The magnetic toner is continuously conveyed to a development section of the photosensitive material during rotation of the member for brushing the toner in contact with the photosensitive material. The distance between the sleeve and photosensitive material is set as equal to or smaller than the maximum thickness of the transferred toner. Subsequently the toner on the photosensitive material is electrostatically transferred to a recording sheet.

5 Claims, 2 Drawing Figures

DEVELOPMENT PROCESS FOR AN ELECTROPHOTOGRAPHIC DUPLICATOR EMPLOYING MAGNETIC TONER

BACKGROUND OF THE INVENTION

This invention relates to a development process for an electrophotographic duplicator employing magnetic toner.

More particularly, this invention relates to a development process for an electrophotographic duplicator employing magnetic toner and a selenium, organic semiconductor, or cadmium sulfide type photosensitive material.

Development processes for electrophotographic duplicators employing magnetic toners are known in the art. For example, a conventional process for an electrophotographic duplicator employing magnetic toner has been used in developing an electrostatic latent image formed on the surface of a zinc oxide type photosensitive material. In this particular process, a paper applied with photoconductive zinc oxide and with an insulating resin binder, commonly referred to as the master paper, is normally employed. The use of the zinc oxide photosensitive material makes it practical to use magnetic toner in the development process because the photosensitive material has a fine roughness, thereby allowing for a concentrated electrical conductivity pattern thereon. The magnetic toner, therefore, has a high adhesion power to the photosensitive material.

A major drawback, however, with respect to the use of zinc oxide photosensitive material in a development process is that the master paper is not durable and when magnetic toner is employed a high magnetic power of more than 1,000 gauss for conveying the magnetic toner to the photosensitive material is required.

To date, the known development processes employing a photosensitive material of a selenium, organic semiconductor or cadmium sulfide type either have not been practical, are uneconomical, or do not provide a high quality duplication. One principal difficulty occurs in applying magnetic toner in this process because of a relatively smooth surface of the photosensitive material and uniform distribution of the electrical conductivity field thereon. Therefore, adhesion of the magnetic toner is not as effective as with a zinc oxide photosensitive material.

In summary, there has been no development process for an electrophotographic duplicator employing magnetic toner with a selenium, organic semiconductor, or cadmium sulfide type photosensitive material that teaches a combination of parameters for economic, practical, and high quality duplication.

SUMMARY OF THE INVENTION

Accordingly, it is a primary object of this invention to eliminate the above-described problems of development processes for electrophotographic duplicators employing magnetic toners.

Another object of this invention is to provide a high quality duplication.

Yet another object of this invention is to provide a development process for an electrophotographic duplicator employing magnetic toner which uses more durable photosensitive materials and provides an economic method of transferring the magnetic toner to the photosensitive material.

Additional objects and advantages of the invention will be set forth in part in the description which follows, and in part will be obvious from the description, or may be learned by practice of the invention. The objects and advantages of the invention may be realized and obtained by means of the instrumentalities and combinations particularly pointed out in the appended claims.

To achieve the foregoing objects and in accordance with the purpose of the invention, as embodied and broadly described herein, the development process for an electrophotographic duplicator employing magnetic toner comprises:

(1) transferring, by magnetic attraction, the magnetic toner of a maximum thickness of 1.5 mm onto a cylindrical non-magnetic sleeve enclosing a magnetic roll wherein the magnetic force of the magnetic roll on the surface of the non-magnetic sleeve is in a range of from 300 to 1,000 gauss and wherein the magnetic toner comprises magnetite in the range of 40 to 70 percent by weight and has a volume specific resistivity higher than $10^7$ ohm-cm and a granulometric measure of less than 30 μm;

(2) forming a latent image on a rotatable drum-shaped member oppositely positioned to the sleeve wherein the member has a smooth surface of a photosensitive material selected from the group consisting of selenium, organic semiconductor, and cadmium sulfide with application of a surface potential in the range of from 300 to 1200 volts;

(3) continuously conveying the transferred magnetic toner during rotation of the drum-shaped member to a development section of the photosensitive material for brushing the magnetic toner in contact with the photosensitive material wherein the distance between the non-magnetic sleeve and oppositely positioned photosensitive material is equal to or smaller than the maximum thickness of the magnetic toner; and (4) electrostatically transferring the magnetic toner on the photosensitive material to a recording sheet.

In a preferred embodiment of the invention, the thickness of the magnetic toner transferred onto the non-magnetic sleeve is from 0.3 to 1.5 mm.

In another preferred embodiment of the invention, the mangetic force of the magnetic roll on the surface of the non-magnetic sleeve is between 300 and 650 gauss and the application of the surface potential on the photosensitive material is about 600 volts. In still another preferred embodiment of the invention, the magnetic force of the magnetic roll on the surface of the non-magnetic sleeve is between 600 to 1000 gauss and the application of the surface potential on the photosensitive material is about 1200 volts.

In the embodiments of the invention, the conveying direction of the magnetic toner is dependent upon several factors. When only the non-magnetic sleeve is rotated, the conveying direction of the magnetic toner is opposite to the rotational direction of the surface of photosensitive material in the development section. Alternatively, the conveying direction of the magnetic toner is the same as the rotational direction of the surface of the photosensitive material in the development section when only the magnetic roll is rotated, the non-magnetic sleeve being stationary. If both the magnetic roll and the sleeve are rotated simultaneously in the same direction, the toner will flow in this direction regardless of the direction of rotation of the drum-shaped member.

BRIED DESCRIPTION OF THE DRAWINGS

The accompanying drawings, which are incorporated in and constitute a part of the specification, illustrate the invention and, together with the description, serve to explain the principles of the invention.

FIG. 1 is a graph showing the density of the magnetic toner on the copied record in relationship to the magnetic force of the magnetic roll on the surface of the non-magnetic transfer sleeve in the development process for an electrophotographic duplicator in accordance with the teachings of the invention; and FIG. 2 is a cross-sectional view of portions of an electrophotographic duplicator for applying the development process according to the teachings of the invention.

DETAILED DESCRIPTION OF THE PREFERRED EMBODIMENTS

Figure 2:
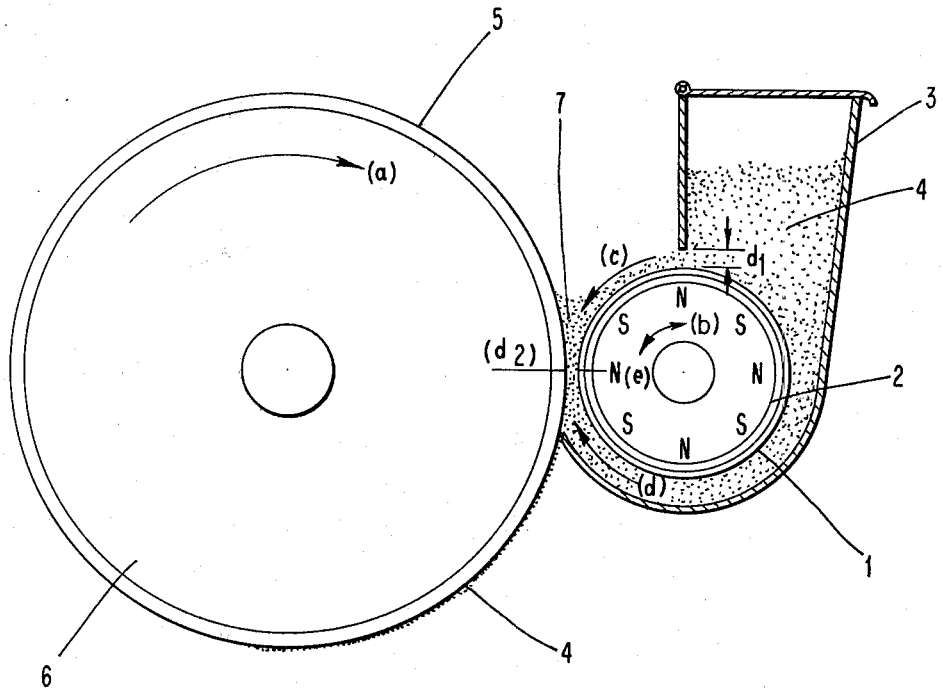

Reference will now be made in detail to the present preferred embodiments of the invention. In FIG. 2, there are shown essential portions of an electrophotographic duplicator used in the development process employing the teachings of this invention.

In accordance with the invention, the development process includes the step of transferring, by magnetic attraction, a magnetic toner of a maximum thickness of 1.5 mm onto a cylindrical non-magnetic sleeve enclosing a magnetic roll wherein the magnetic force of the magnetic roll on the surface of the non-magnetic sleeve is in a range of from 300 to 1000 gauss. The magnetic toner comprises magnetite in the range of 40 to 70 percent by weight and has a volume specific resistivity higher than $10^7$ ohm-cm and a granulometric measure of less than 30 $\mu$m. The magnetic toner, as is conventional, normally includes carbon black.

As here embodied and shown in FIG. 2, the duplicator used in applying the development process has a reservoir supply tank 3 for the magnetic toner 4 adjacent to a cylindrical non-magnetic sleeve 1. Sleeve 1 is rotatable either in a counter-clockwise direction indicated by arrow (e) or a clockwise direction indicated by arrow (b). Enclosed in a cooperating position within the non-magnetic sleeve 3 is a magnetic roll 2 which is also rotatable separately from the sleeve 3 in either a counter-clockwise or clockwise direction. The magnetic toner 4 is transferred from the supply tank 3 onto the surface of the cylindrical sleeve 1 and retained thereon by the magnetic force from the magnetic roll 2 effective on the surface of the sleeve.

In accordance with the invention, the development process further includes the step of forming a latent image on a rotatable drum-shaped member oppositely positioned to the non-magnetic sleeve, the drum-shaped member having a smooth surface of a photosensitive material selected from the group consisting of selenium, organic semiconductor and cadmium sulfide.

As here embodied in FIG. 2, the duplicator has a drum-shaped member 6 with a smooth photosensitive material 5 prepared on the outer surface with an isolating coating layer over it. Conventionally, the photosensitive material 5 has applied to it a surface potential for development of the electrostatic latent image. The latent image is typically formed by applying to the photosensitive surface a uniform electrostatic charge and then exposing the charged surface to a light pattern which results in charge loss in the light struck areas. Where the surface is not exposed to a light struck area, there is no charge loss.

In accordance with the invention, the development process includes the further step of continuously conveying the transferred magnetic toner to a development section of the photosensitive material during rotation of the drum-shaped member for brushing the magnetic toner in contact with the photosensitive material. As shown in FIG. 2, the magnetic toner 4 transferred from the supply tank 3 onto the sleeve 1 will be conveyed to the development section 7 for brushing contact with the photosensitive material 5.

In the development process of this invention, there has been found a significant relationship between the electric surface potential of the photosensitive material 5, i.e., selenium, organic semiconductor, or cadmium sulfide and the strength of the magnetic force of the magnetic roll 2 used in the electrophotographic duplicator depicted in FIG. 2. More particularly, it has been found that when employing the magnetic toner 4, as previously described, consisting of 40 to 70 percent by weight magnetite and having a specific resistivity limit of more than 10 ohm-cm and a granulometric measure of less than 30 $\mu$m, a surface potential of higher than 1200 volts provides an electrical field too strong for the magnetic toner particles to adhere to the photosensitive material during development. It has been further found that when utilizing a surface potential of less than 300 volts, the electrical field is too weak for the magnetic toner particles to attach sufficiently during development. In both cases, a satisfactory duplication cannot be obtained. The development process of this invention achieves optimum results for duplication by utilizing a surface potential on the photosensitive material in a range of 300 -1200 volts, a magnetic roll 2 having a magnetic force on the surface of sleeve 1 in a range of from 300 to 1000 gauss, and the magnetic toner 4 of the composition as previously described.

To achieve the optimum results using the parameters immediately noted above, the distance between the non-magnetic sleeve and oppositely positioned photosensitive material is made equal to or smaller than the maximum thickness of the magnetic toner transferred onto the sleeve. As here embodied, a predetermined gap, designated in FIG. 2 as $d_1$, is formed at one end of the toner supply tank 3 between the tank 3 and the non-magnetic sleeve 1. Accordingly, this predetermined gap $d_1$ will provide the maximum thickness of the magnetic toner 4 transferred onto the surface of the cylindrical non-magnetic sleeve 1 during operation of the duplicator and conveyance of the toner 4 toward the development section 7 in a counterclockwise direction. It can be seen that a similar predetermined gap can be provided to allow a certain thickness of the toner when conveyed to the development section 7 in a clockwise direction.

As here embodied, there is a predetermined gap between the non-magnetic sleeve 1 and the oppositely positioned photosensitive material 5 in the development section 7 which is designated in FIG. 2 as $d_2$. Consequently, the distance between the non-magnetic sleeve and oppositely positioned photosensitive material in the development process of this invention which is equal to or smaller than the maximum thickness of the transferred magnetic toner can be described as: $d_2 \leqq d_1$.

It has been found that when utilizing the magnetic toner of the type previously described, a surface potential in the range of 300–1200 volts, and a magnetic force in the range of 300–1000 gauss, the thickness of the magnetic toner, such as designated by $d_1$, should preferably be less than 1.5 mm. Accordingly, the distance between the gap at the photosensitive material 5 and the sleeve 1, or gap $d_2$, would be equal to or less than 1.5 mm. t is desirable to transfer the magnetic toner 4 on sleeve 3 in an even smaller thickness than 1.5 mm. However, in this development process for use in a duplicator having the rotatable drum-shaped member 6 and the rotatable cylindrical sleeve 1, magnetic toner 4 transferred in a thickness of less than 0.3 mm causes an uneven development and thus a poor quality duplication. This is principally caused by variation in the gap $d_2$ between the non-magnetic sleeve 1 and the photosensitive material 5 due to the difficulty in obtaining a perfect circular surface on the sleeve 1 and member 6 and the relative rotation to each other about respective axes. As here embodied, the thickness of the magnetic toner 4 transferred onto the non-magnetic sleeve 1, therefore, should be maintained in the range of from 0.3 to 1.5 mm.

If the photosensitive material 5 is rotated in the direction shown in FIG. 2 by arrow (a), good duplication quality was achieved when the conveyance direction of the magnetic toner 4 was made in several different manners. As here embodied, when only the magnetic roll 2 is rotated in a clockwise direction as shown in FIG. 2 by directional arrow (b), the magnetic toner 4 is conveyed to the development section 7 on the non-magnetic sleeve 1 by the shifting magnetic field formed with the rotation of the magnetic roll 2 in a conveying direction shown by arrow (c). Alternatively, when only the non-magnetic sleeve 1 is rotated, as indicated by the direction shown in FIG. 2 by arrow (d), the magnetic toner 4 is conveyed to the development section 7 as indicated by arrow (d).

When both the non-magnetic sleeve 1 and the magnetic roll 2 are rotated simultaneously and in the same direction, the magnetic toner 4 is conveyed in the same rotational direction as the non-magnetic sleeve 1. For example, when both the rotational directions of the non-magnetic sleeve 1 and the magnetic roll 2 are in a clockwise direction, as indicated by arrow (b) in FIG. 2, the conveyance direction of the magnetic toner 4 is in the same direction as indicated by the arrow (d), or through the gap $d_2$ in a direction opposite to the rotational direction of the surface of the photosensitive material 5. When both the rotational directions of the non-magnetic sleeve 1 and the magnetic roll 2 are in a counterclockwise direction as indicated by arrow (e) in FIG. 2, the conveyance direction of the magnetic toner 4 is indicated by arrow (c), or in the same rotational direction through the gap $d_2$ as the surface of the photosensitive material 5.

As the final step of the development process according to this invention, the magnetic toner on the photosensitive material is electrostatically transferred in a conventional manner to a recording sheet.

Figure 1:
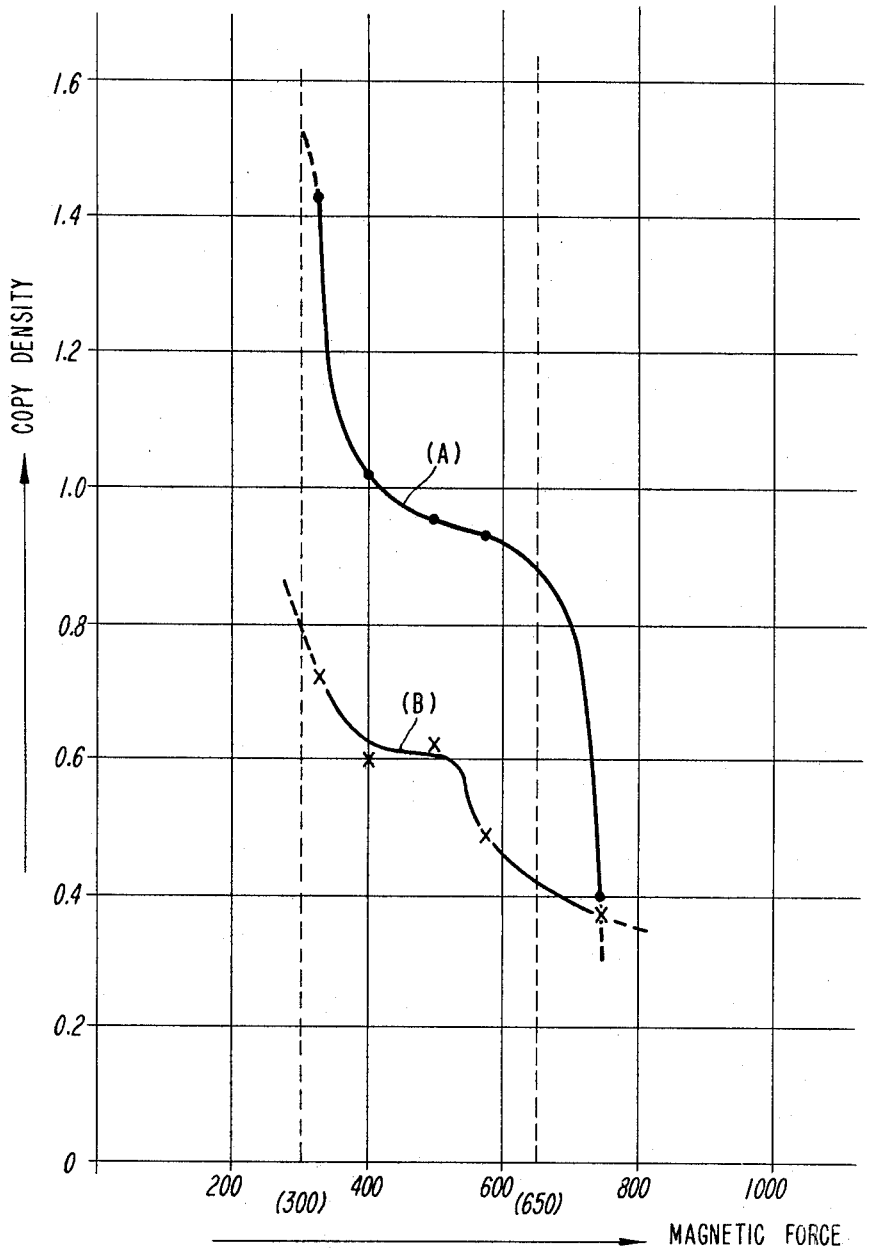

In the development process of this invention, the surface potential of the photosensitive material changes proportionally to the magnetic force applied to the nonmagnetic sleeve of the duplicator. Consequently, when a high surface potential is selected for the photosensitive material, a strong magnetic force is required. Referring now to FIG. 1, the illustrated graph depicts the relationship of the density of the copied image to the magnetic flux density on the transfer sleeve. The X coordinate is stated in gauss while the Y coordinate represents density of the copied image compared to the original. The data depicted in FIG. 1 was obtained utilizing a surface potential on the photosensitive material of 600 volts. Curve (A) shows copy density for duplication on one type of paper (SF 730 of Sharp Co.) while curve (B) shows copy density for duplication on a second type of paper (Bix Paper of Konishiroku Co.).

As can be seen from the graph of FIG. 1, the density of the copied image in each case varies the greatest when the magnetic flux density is less than 300 gauss or more than 650 gauss. Consequently, outside the range of 300–650 gauss, the development process becomes unstable. In the range of 300–650 gauss, good quality duplication is obtained with a stable copy density as shown by the more level slopes in the curves (A) and (B). For a magnetic force of less than 300 gauss, the magnetic force on the non-magnetic sleeve is too weak for the magnetic toner to effect sufficient conveyance, while for a magnetic flux density higher than 650 gauss, the magnetic force is too strong for the magnetic toner to adhere to the surface of the photosensitive material. When a surface potential on the photosensitive material of 1200 volts is employed, an excellent image density range stabilized using a magnetic force on the sleeve in the range of from 600 to 1000 gauss.

The following example will illustrate use of the development process of the invention for an electrophotographic duplicator schematically depicted in FIG. 2. Only the magnetic roll 2 was rotated so that the conveyance of the magnetic toner 4 to the development section 7 was in a direction indicated by arrow (c), i.e., through the gap of $d_2$ in the same direction as the surface of the photosensitive material 5. In this example, the photosensitive material 5 comprised selenium-tellurium and the rotatable drum-shaped member 6 on which the photosensitive material was placed had a circumferential speed of approximately 100 mm/sec. The surface potential of the photosensitive material was set at about 400 volts. The magnetic toner applied during the development process contained magnetite of approximately 65% by weight, and had a volume specific resistivity of $10_{12}$ ohm-cm. The magnetic force on the sleeve 1 created by the magnetic roll 2 was approximately 500 gauss. The magnetic roll 2 was 29 mm$\phi$ and had a rotational speed of 1200 r.p.m. The maximum thickness of the magnetic toner transferred to the sleeve, i.e., gap $d_1$, was set at 0.7 mm, while the distance between the sleeve 1 and the oppositely positioned photosensitive material 5, i.e., gap $d_2$, was set at 0.5 mm.

The development process of this invention embodied in the example described above resulted in an exceptionally high quality duplication. In doing so, a combination of parameters for the magnetic toner, magnetic roll, and photosensitive material were obtained which allowed for longer usage of the materials involved and which offered a very stable copy density in duplication. In view of this, it can be seen that this particular development process for an electrophotographic duplicator employing magnetic toner has solved a number of drawbacks of the conventional development processes for duplicators employing magnetic toner.

It will be apparent to those skilled in the art that modifications and variations could be made in the development process of this invention without departing from the spirit or scope of the invention. Thus, it is intended that the present invention cover the modification and variations of this invention provided they come within the scope of the appended claims and their equivalents.

What is claimed is:

1. A development process for an electrophotographic duplicator employing magnetic toner comprising:

(a) transferring, by magnetic attraction, the magnetic toner of a maximum thickness of 1.5 mm onto a cylindrical non-magnetic sleeve enclosing a magnetic roll having a predetermined magnetic force on the surface of the non-magnetic sleeve wherein the magnetic toner comprises magnetite in the range of 40 to 70 percent by weight and has a volume specific resistivity higher than $10^7$ ohm-cm and a granulometric measure of less than 30μm;

(b) forming a latent image on a rotatable drum-shaped member oppositely positioned to the sleeve wherein the member has a smooth surface of a photosensitive material selected from the group consisting of selenium, organic semiconductor, and cadmium sulfide with the application of a predetermined surface potential, said predetermined magnetic force and said predetermined surface potential having been selected in view of one another to be in proportion, wherein said magnetic force is between about 300 and 650 gauss when said surface potential is about 600 volts and said magnetic force is between about 600 and 1000 gauss when said surface potential is about 1200 volts;

(c) continuously conveying the transferred magnetic toner to a development section of the photosensitive material during rotation of the drum-shaped member for brushing the magnetic toner in contact with the photosensitive material wherein the distance between the non-magnetic sleeve and oppositely positioned photosensitive material is equal to or smaller than the maximum thickness of the magnetic toner; and (d) electrostatically transferring the magnetic toner on the photosensitive material to a recording sheet.

2. The development process of claim 1 wherein the thickness of the magnetic toner transferred onto the non-magnetic sleeve is from 0.3 to 1.5 mm.

3. The development process of claim 1 wherein said non-magnetic sleeve and said magnet roll are each independently rotatable, said conveying step including fixing said non-magnetic member and rotating said magnet roll in the same rotational sense as said drum-shaped member, wherein the conveying direction of the magnetic toner is the same as the rotational direction of the surface of the photosensitive material in the development section.

4. The development process of claim 1 wherein said non-magnetic sleeve and said magnet roll are each independently rotatable, said conveying step including fixing said magnet roll and rotating said non-magnetic sleeve in the same rotational sense as said drum-shaped member, wherein the conveying direction of the magnetic toner is opposite to the rotational direction of the surface of the photosensitive material in the development section.

5. The development process of claim 1 wherein said non-magnetic sleeve and said magnet roll are each independently rotatable, said conveying step including rotating simultaneously both said magnet roll and said non-magnetic member, wherein the conveying direction of the magnetic toner is the same as the rotational direction of the non-magnetic sleeve in the development section.

* * * * *